United States Patent [19]

Ootsuka

[11] Patent Number: 5,014,027

[45] Date of Patent: May 7, 1991

[54] ELECTROMAGNETIC CONTACTOR

[75] Inventor: Shigeharu Ootsuka, Nagoya, Japan

[73] Assignee: Mitsubishi Denki Kabushiki Kaisha, Tokyo, Japan

[21] Appl. No.: 497,204

[22] Filed: Mar. 22, 1990

[30] Foreign Application Priority Data

Mar. 24, 1989 [JP] Japan ..... 1-72681

[51] Int. Cl.[5] ..... H01H 67/02

[52] U.S. Cl. ..... 335/132; 335/131; 335/201

[58] Field of Search ..... 335/131, 132, 136, 78–85, 335/256, 201

[56] References Cited

U.S. PATENT DOCUMENTS 4,490,701 12/1984 Dietrich et al. ..... 335/131

FOREIGN PATENT DOCUMENTS 60-246531 12/1985 Japan .

*Primary Examiner*—Leo P. Picard
*Assistant Examiner*—Lincoln Donovan
*Attorney, Agent, or Firm*—Burns, Doane, Swecker & Mathis

[57] ABSTRACT

In an electromagnetic contactor having a fixed iron core (1), a flat portion (1*b*) of the fixed iron core is disposed along a moving direction of movable contacts (15) to come close to each gap between fixed contacts (17) and the movable contacts (15) with a shielding sheet (40) of an insulation material put thereon.

5 Claims, 5 Drawing Sheets

ELECTROMAGNETIC CONTACTOR

FIELD OF THE INVENTION AND RELATED ART STATEMENT

1. Field of the Invention

The present invention relates to an electromagnetic contactor and more particularly to an improvement in arc-extinguishing performance.

2. Description of the Related Art

FIG. 3 is a cross-sectional view showing a conventional electromagnetic contactor disclosed in the Japanese unexamined patent application (TOKKAI) Sho No. 63-79304. This electromagnetic contactor includes a polarized electromagnet. In FIG. 3, a channel-shaped fixed iron core 101, an L-shaped magnetic pole sheet 102 and a coil spool 105 on which a coil 105A is wound are fixedly mounted to a case 130 to constitute an electromagnet. An H-shaped movable iron core 104 is movably mounted to the case 130 in the right and left direction of the figure. A right end of the movable iron core 104 is engaged with a link 106 via a linkage pin 108. The link 106 is made of molded resin etc. and is pivotally mounted to the case 130 around a fulcrum pin 107. A pair of spacers 109*a* and 109*b* are provided in order to adjust both a stroke of the movable iron core 104 and attraction force between the movable iron core 104 and the fixed iron core 101, by selection of their thicknesses. The above-mentioned parts constitute an electromagnet part A within the case 130. A crossbar 110 is engaged with the link 106 and makes sliding action to carry movable contacts (not shown), which are mounted on the crossbar 110, toward fixed contact (not shown). The crossbar 110 with the movable contacts held thereon and the fixed contacts, which form a contact part B, are mounted within a cover 120. The cover 120 couples with the case 130, thereby forming an exterior part of the electromagnetic contactor. The contact part B is isolated from the electromagnet part A by a shielding sheet 140 made of a flat insulation board e.g. of a synthetic resin. The crossbar 110 is urged from the cover 120 to move rightward by a compression spring 150. More specifically, the fulcrum pin 107 is inserted into a hole (not shown) formed in an illustration-omitted part of the coil spool 105, and the fixed iron core 101 and the magnetic pole sheet 102 are fixed in grooves (not shown) formed in the coil spool 105. The coil spool 105 is fixedly positioned by a pair of projections 111.

Next, operation of the above-mentioned conventional electromagnetic contactor is described. A state shown by FIG. 3 is a released state of the electromagnetic contactor. When the coil 105A is excited from the released state, the movable iron core 104 is attracted to the fixed iron core 101 in a direction shown by an arrow X. The crossbar 110 is thereby pushed leftward via the link 106 and makes sliding motion in a direction shown by an arrow Y. At that time, the movable contacts make contact with the fixed contacts, thereby electrically making contact. When excitation of the coil 105A is lost, the crossbar 110 is pushed rightward owing to an expansion force of the compression spring 150 and returns to the released state. At that time, the movable contacts detach from the fixed contacts, thereby electrically breaking contact. In breaking contact, arcs are generated between the fixed contacts and the movable contacts. These arcs are extended by a separating motion of the movable contacts from the fixed contacts, and finally, the arcs are extinguished by being extended to a length of a gap between each pair of the movable contacts and the fixed contacts.

However, when the gap is smaller than a predetermined value due to a reason such as an accumulation of carbon, it may be impossible to interrupt the arcs, thereby resulting in failure of interruption which is a very hazardous state for the electromagnetic contactor.

OBJECT AND SUMMARY OF THE INVENTION

An object of the present invention is to offer an electromagnetic contactor which can surely extinguish the arcs generated even in very small gaps between the fixed contacts and the movable contacts.

In order to achieve the above-mentioned object, the electromagnetic contactor of the present invention comprises:

a casing;

a plurality of fixed contacts fixedly mounted to the casing;

a crossbar which is slidably mounted to the casing and has a plurality of movable contacts to move in and out of contact with the fixed contacts;

an electromagnet unit including an electromagnet fixedly mounted to the casing and a movable iron core which is movably mounted to the casing to move the crossbar, the electromagnet having a fixed iron core which is disposed along a moving direction of the movable contacts to come close to each gap between the fixed contacts and the movable contacts; and a shielding sheet which is provided between the movable contacts and the fixed iron core to insulate from each other.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENT

Hereafter, a preferred embodiment of the present invention is described with reference to the accompanying drawings.

Figure 1:
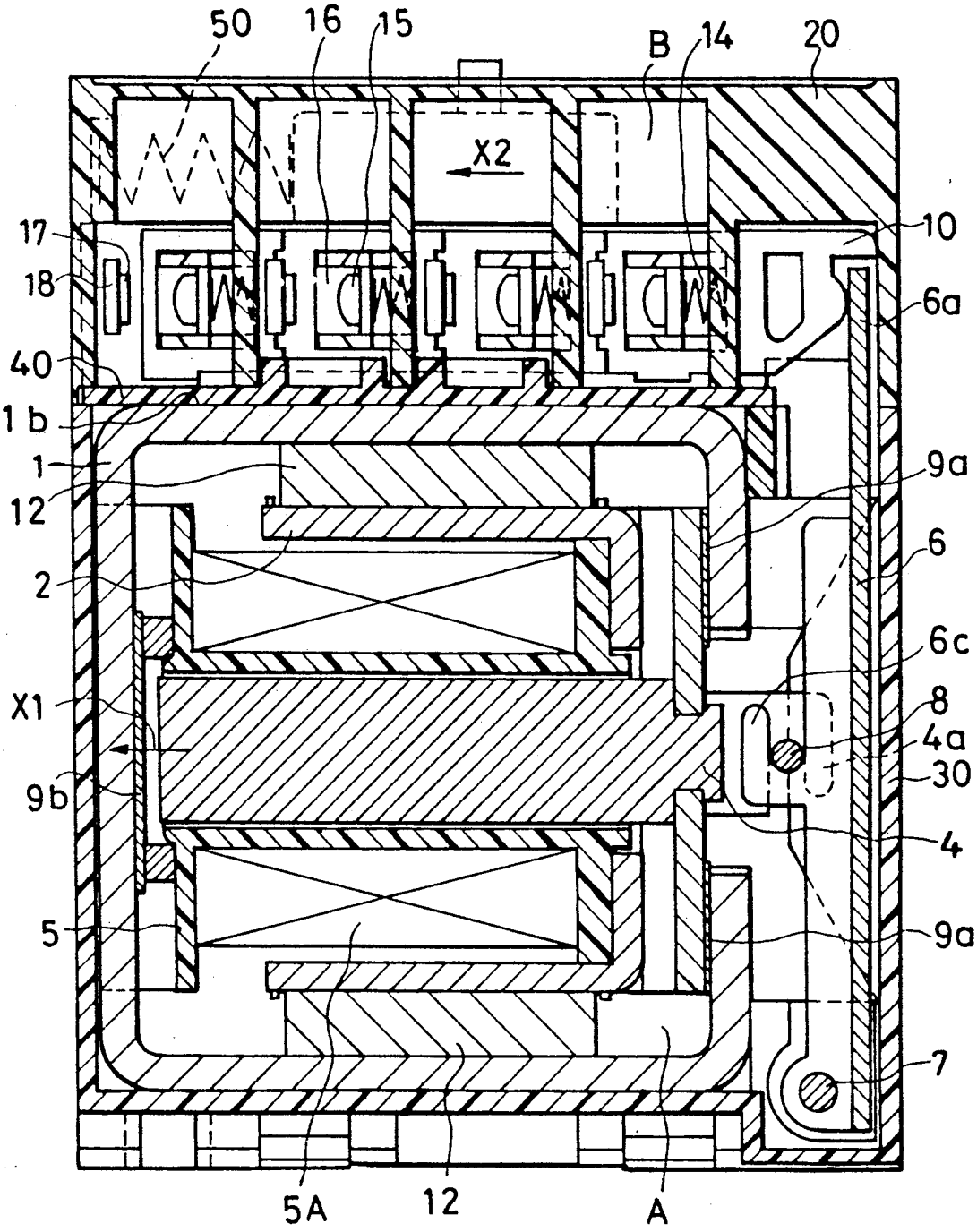
FIG. 1 is a cross-sectional view showing an electromagnetic contactor of the present invention.
Figure 2:
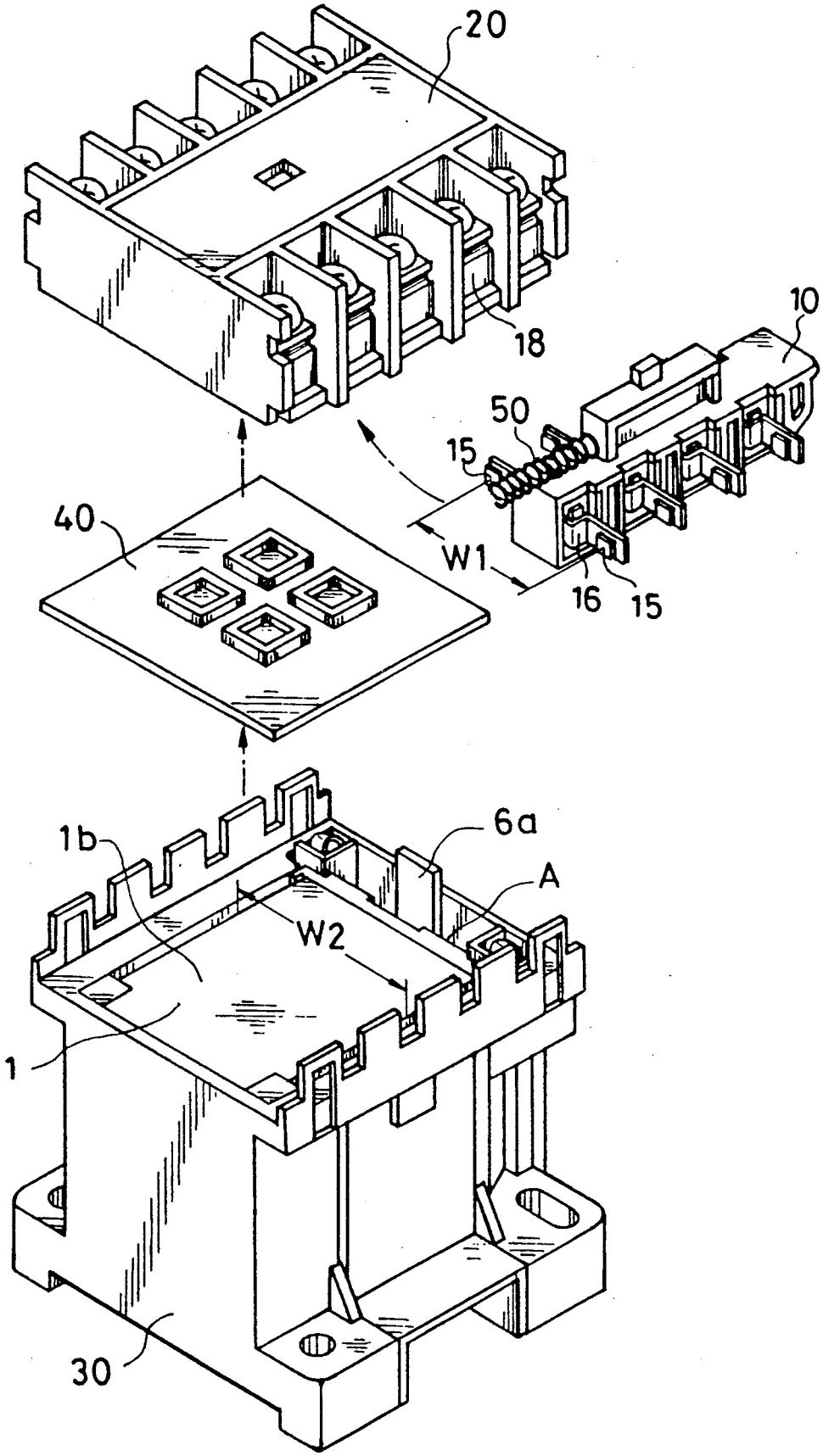
FIG. 2 is a perspective view showing main parts of the electromagnetic contactor of the present invention at an assembling stage.

FIG. 1 is a cross-sectional view showing an electromagnetic contactor of the present invention. FIG. 2 is a perspective view showing the electromagnetic contactor at an assembling stage. In these figures, a channel-shaped fixed iron core 1, L-shaped magnetic pole sheets 2 and a coil spool 5 on which a coil 5A is wound are fixedly mounted to a case 30 to constitute an electromagnet. The fixed iron core 1 is made of a ferromagnetic substance. Permanent magnets 12 are provided between the fixed iron core 1 and the magnetic pole sheets 2 in order to assist the attraction by the electromagnet to thereby lighten a burden of the coil 5A. These permanent magnets 12 also improve a performance to withstand the mechanical shock from the outside. A T-shaped movable iron core 4 is movably mounted to the case 30 in the right and left direction of FIG. 1. A right end of the movable iron core 4 is engaged with a link 6 via a linkage pin 8. The link 6 is made of a metal sheet and is pivotally mounted to the case 30 around a fulcrum pin 7. Spacers 9*a* and 9*b* are provided in order to adjust attraction force between the movable iron core 4 and the fixed iron core 1. The above-mentioned parts constitute an electromagnet part A within the case 30. A crossbar 10 is engaged with the link 6 and makes sliding action to carry plural pairs of movable contacts 15 toward plural pairs of fixed contacts 17, respectively. Each pair of the movable contacts 15 are provided on both end portions of a movable contact arm 16, thereby being connected in series with each other, and each of the fixed contacts 17 is provided on a fixed contact arm 18. The movable contact arm 16 is slidably held by the crossbar 10 and is urged by a compression spring 14 in order to give a contacting pressure to the movable contact 15. The fixed contacts 17 and the fixed contact arms 18 are built in a cover 20, and the crossbar 10 with the movable contacts 15 is mounted within the cover 20. These components mounted within the cover 20 constitute a contact part B against the electromagnet part A. The cover 20 couples with the case 30, thereby forming an exterior part of the electromagnetic contactor. The contact part B is insulated from the electromagnet part A by a shielding sheet 40 made of a flat insulation board e.g. of a synthetic resin. The crossbar 10 is urged from the cover 20 to move rightward by a compression spring 50.

Figure 2A:
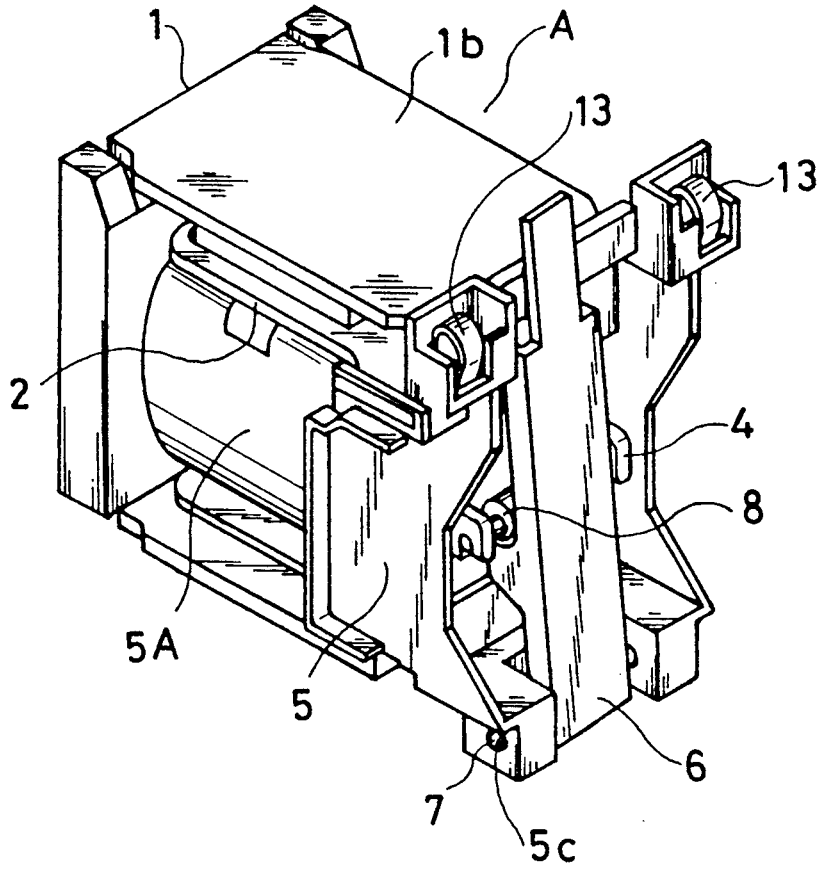
FIG. 2*a* is a perspective view showing the electromagnet part A after completion of assembly.

FIG. 2*a* is a perspective view showing the electromagnet part A. The fulcrum pin 7 is inserted into holes 5*c* of the coil spool 5. The fixed iron core 1 and the magnetic pole sheet 2 are tightly fit onto the coil spool 5. The electromagnet part A is thus integrated into one unit body. An excitation voltage is supplied to the coil 5A from a pair of contact terminals 13, 13 which are to be connected to coil terminals (not shown).

In FIG. 2, a width W2 of an upper flat portion 1*b* of the fixed iron core 1 is made equal to or larger than a width W1 between a pair of movable contacts 15 and 15 which are provided on the movable contact arm 16. The upper flat portion 1*b* is disposed under the fixed contacts 17 (FIG. 1) and the movable contacts 15 with the shielding sheet 40 put therebetween. This shielding sheet 40 is tightly attached to the upper flat portion 1*b*.

Next, operation of the above-mentioned electromagnetic contactor is described. A state shown by FIG. 1 is a released state of the electromagnetic contactor. When the coil 5A is excited from the released state, the movable iron core 4 is attracted to the fixed iron core 1 in a direction shown by an arrow X1. The crossbar 10 is thereby pushed leftward via the link 6 and makes sliding motion in a direction shown by an arrow X2. At that time, the movable contacts 15 make contact with the fixed contacts 17, thereby electrically making contact. When excitation of the coil 5A is lost, the crossbar 10 is pushed rightward by an expansion force of the compression spring 50 and returns to the released state. At that time, the movable contacts 15 detach from the fixed contacts 17, thereby electrically breaking contact. In breaking contact, arcs are generated between the fixed contacts 17 and the movable contacts 15.

Figure 2B:
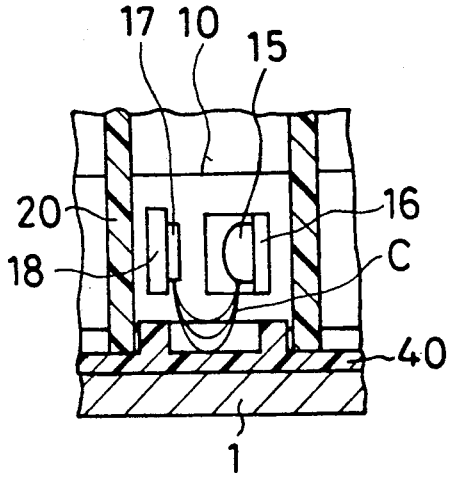
FIG. 2*b* is a partially enlarged view showing a part around fixed contacts 17 and movable contacts 15.
Figure 2C:
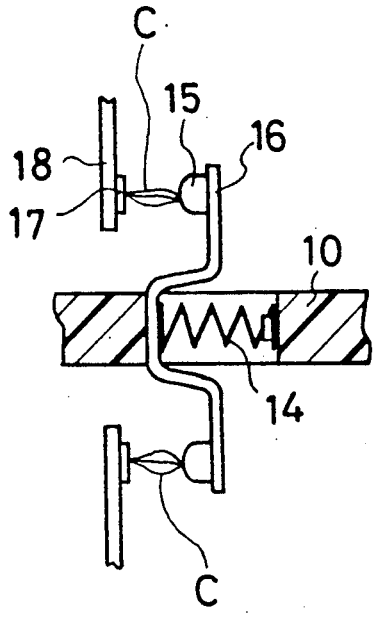
FIG. 2*c* is a plane view of FIG. 2*b*.
Figure 3:
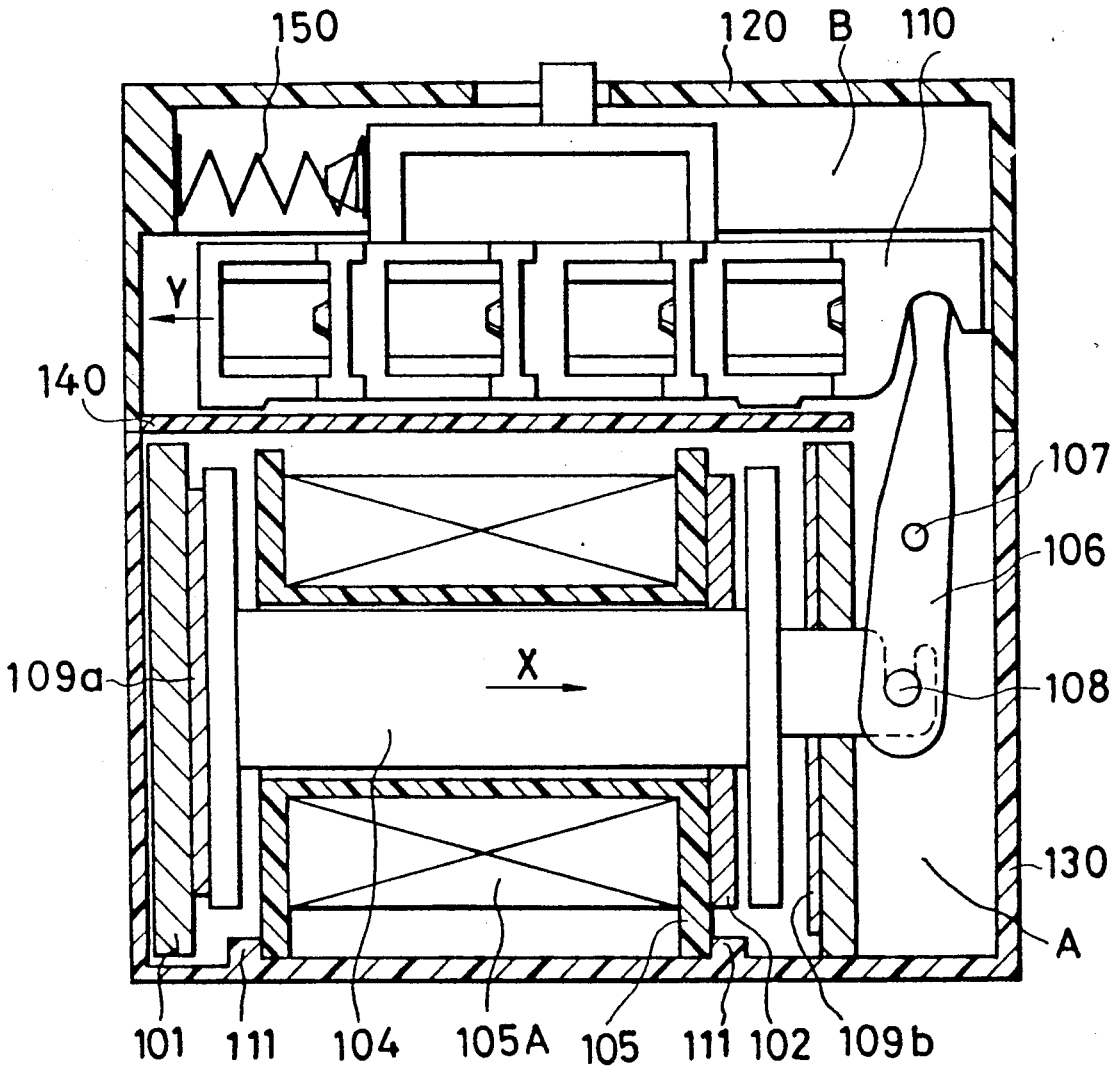
FIG.3 (Prior Art)
FIG. 3 is a cross-sectional view showing the conventional electromagnetic contactor.

FIG. 2*b* is a partially enlarged view showing a part around the fixed contacts 17 and the movable contacts 15, and FIG. 2*c* is a plane view of FIG. 2*b*. As aforementioned, arcs C are generated between the fixed contacts 17 and the movable contacts 15 during the time of current-breaking. These arcs C, hence the currents, make magnetic fields therearound. Since a magnetic field generally has a property to move toward and enter a magnetic substance having a high permeability, the magnetic fields are attracted toward the nearby fixed iron core 1. As a result, the arcs C are extended to form an arch shape (FIG. 2*b*) toward the fixed iron core 1. An arc length is thus increased, so that arc-extinguishing is rendered easy and an interrupting time is shortened. By employing the above-mentioned construction for arc-extinguishing, stable and quick interrupting ability is obtained without any additional arc-extinguishing component such as an arc-extinguishing plate, even in a small size electromagnetic contactor having a small gap of contact.

In the above-mentioned arc-extinguishing construction, it is preferable to arrange the upper flat portion 1*b* (FIG. 1, 2 and 2*a*) close to the fixed contacts 17 and the movable contacts 15. Since the shielding sheet 40 receives heat by the arc, it is preferable to use a thin and arc-resistant insulation material. In order to make the above-mentioned arc-extending effect on all arcs generated between each pair of the fixed contacts 17 and the movable contacts 15, it is necessary to arrange the upper flat portion 1*b* under all of the fixed contacts 17 and the movable contacts 15 and in parallel with a moving direction of the movable contacts 15. If the width W2 (FIG. 2) is very much smaller than the width W1 (FIG. 2), both the arcs C, C (FIG. 2*c*) are extended to come close to each other, thereby making a fear of causing a shortcircuit.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. An electromagnetic contactor comprising:

a casing;

a plurality of fixed contacts fixedly mounted to said casing;

a crossbar which is slidably mounted to said casing and has a plurality of movable contacts to move in and out of contact with said fixed contacts;

an electromagnet unit including an electromagnet fixedly mounted to said casing and a movable iron core which is movably mounted to said casing to move said crossbar, said electromagnet having a fixed iron core which is disposed along a moving direction of said movable contacts sufficiently close to each gap between said fixed contacts and said movable contacts to attract electric arcs generated between said fixed contacts and said movable contacts when said movable contacts are moved out of contact with said fixed contacts; and a shielding sheet which is provided between said movable contacts and said fixed iron core to insulate from each other.

2. An electromagnetic contactor in accordance with claim 1, wherein said movable contacts comprise a pair of contacts provided on a movable contact arm per one circuit to be closed/opened, and a width of said fixed iron core is equal to or larger than a width between said series-connected contacts.

3. An electromagnetic contactor comprising:

an electromagnet having a movable iron core which makes a motion in a straight line;

a crossbar which moves in parallel with said movable iron core and has a plurality of movable contact arms, each of which has a pair of movable contacts;

a cover in which a plurality of fixed contacts are fixedly mounted and said crossbar is slidably mounted to move said movable contacts in and out of contact with said fixed contacts;

a shielding sheet for making a shield between said electromagnet and each of said fixed contacts and movable contacts; and a fixed iron core which is mounted to said electromagnet and has a flat portion having a width equal to or larger than a width between said series-connected movable contacts and being disposed under said fixed contacts and movable contacts with said shielding sheet put therebetween in sufficient proximity to said fixed contacts and said movable contacts to attract electric arcs generated between said fixed contacts and said movable contacts when said movable contacts are moved out of contact with said fixed contacts.

4. An electromagnetic contactor in accordance with claim 1 or 3, wherein said shielding sheet is made of arc-resistant material.

5. An electromagnetic contactor in accordance with claim 1 or 3, wherein said shielding sheet is tightly attached to said fixed iron core.

* * * * *